US005206782A

United States Patent [19]

Landmeier et al.

[11] Patent Number: 5,206,782

[45] Date of Patent: Apr. 27, 1993

[54] SURGE LOCK POWER CONTROLLER

[75] Inventors: Phillip C. Landmeier, Irvine; Douglas J. Morgan, Del Mar; Gerald E. Hammond, Tustin, all of Calif.

[73] Assignee: Hirsch Electronics Corporation, Irvine, Calif.

[21] Appl. No.: 642,818

[22] Filed: Jan. 18, 1991

[51] Int. Cl.[5] ..... E05B 47/02

[52] U.S. Cl. ..... 361/154; 307/66; 361/172

[58] Field of Search ..... 307/66, 48, 75; 361/154, 172; 326/299, 303

[56] References Cited

U.S. PATENT DOCUMENTS 4,386,308 5/1983 Emile, Jr. et al. ..... 320/22

4,967,305 10/1990 Murrer et al. ..... 361/172

*Primary Examiner*—A. D. Pellinen

*Assistant Examiner*—Aditya Krishnan

*Attorney, Agent, or Firm*—Blakely, Sokoloff, Taylor & Zafman

[57] ABSTRACT

A power controller for electric locks which draw large startup current surges which controls and manages the energy of a pair of storage batteries to reliably operate such electric locks and provide steady-state power to auxiliary system components both with AC power present and in the absence thereof, so long as the stored charge in the batteries is able, to thereafter maintain a steady source of power to the system as long as possible, and to be self-starting upon the return of AC power, all without ever placing the electric locks in a partially unlocked or "hung" state. The two storage batteries are normally maintained charged through an AC power source, and both cooperate to provide the surge power. On loss of AC power, both still provide surge power so long as one can maintain the steady state power, and thereafter the other battery alone provides surge power so long as possible. On restart from a batteries discharged condition, surge power demand is tested periodically and immediately terminated when inadequate, thereby having minimal effect on the charging rate of the batteries.

10 Claims, 4 Drawing Sheets

SURGE LOCK POWER CONTROLLER

BACKGROUND OF THE INVENTION

1. Field of the Invention

This invention relates to the field of electrically powered locks as typically found in security systems.

2. Prior Art

In the security industry, there is a class of electromagnetically actuated locks which are very difficult to power. These locks draw an enormous surge of power to actuate the bolt, but once actuated, draw a much smaller "holding current". These type of locks may be referred to as "surge locks".

Surge locks are often found on doors with big, heavy lock hardware such as crash bars and the like, made by Von Duprin and others. These locks are typically powered by 24 Volts DC, and have two solenoids or "coils": a high power starter coil and a smaller holding coil. The holding coil is energized continuously while the lock is unlocked, but only pulls with enough force to maintain an already retracted bolt in the retracted position. The starter coil pulls with a great deal of force to overcome friction and retract the bolt, but this coil can only be energized for a moment without overheating and burning out. In a good design, the start coil is equipped with a cutout switch which automatically removes power once the bolt is retracted, together with a simple timing circuit which disables the starter coil approximately 300 milliseconds after the first application of power to prevent coil burnout in the event the lock fails to timely actuate for some reason. A surge lock is directly analogous to a split-phase electric motor with separate starting and running windings. In such a motor, the starting winding is shut off by a centrifugal switch after the motor has partially come up to speed. By way of example, surge locks of the foregoing type include the Von Duprin model 33 locks.

Unfortunately, some of the more popular locks are equipped with only the passive timing device. This timing device requires that power be applied suddenly to fire the start coil. The timing circuit used requires that the application of power (24 VDC) have a rapid rise-time in order to trigger properly. If power is applied gradually so that the voltage rises from 0 to 24 Volts DC over a period of 1 second or more, the timing circuit fails to trigger, the lock fails to actuate and is then "hung". A lock in this state has the full 24 Volts applied, but is still locked.

Surge locks draw upwards of 400 watts of power during the start phase (24 VDC at 16 Amps), dropping after 300 ms or so to ½ amp of holding current (12 watts). The cost of providing a power supply for these locks which is capable of providing more than 16 amps of continuous current is unreasonable. Also when powered by such a power supply, such a lock may hang up because of an AC power line voltage sag, which of course may originate from causes totally independent of the power supply or lock system operation. For the past several years the assignee of the present invention has tried to address this problem by developing products which attempt to solve this problem more elegantly than by the brute force approach of using a 400 watt power supply to power a 12 watt lock. To do this, the large surge capacity of a small lead-acid storage battery has been used to start these locks. These designs are deceptively simple, and under ideal conditions, they work fine. However, in practice these designs have been less than ideal in the varying conditions found in the field.

In an attempt to solve this problem many designs have been employed. Attempts have been made to provide the required surge current by means of huge capacitors, which proved hopeless. A design is being produced which utilizes dual relays. One relay is actuated continuously and provides a resistively limited holding current. The other relay provides an unlimited surge current, but is only actuated momentarily, by means of a passive capacitor delay circuit. The two relay solution only works with certain types of locks and has problems powering certain types of magnetic locks.

A recent design employs an AC power supply providing regulated and current limited 28 Volts DC and two lead-acid (gel-cell) storage batteries. One battery (the system battery) provides AC power-fail backup for the steady-state load and the other (the surge battery) provides only surge power for starting surge locks. The two types of loads, however, are completely isolated from each other. This results in suboptimal performance when AC power fails. The system battery discharges completely (because of the steady load) while the surge battery remains almost fully charged, but is unable to assist in holding up the steady state load.

These designs exhibit other major problems. When AC power fails, the batteries are allowed to overdischarge completely (to 0 Volts). Overdischarging a lead-acid battery causes plate damage and sulfation which permanently reduce the battery's storage capacity and leads ultimately to shorted cells and early failure. Furthermore, allowing the voltage, under discharge conditions, to fall below 12 Volts serves no useful purpose and can, in fact, cause problems for the equipment being powered. Overdischarging also causes a battery's internal impedance to rise which reduces its ability to accept a charging current, thus, it takes longer to recharge.

When AC power is reapplied with discharged batteries, other problems appear:

1) If the system was set up to energize the lock immediately upon application of power, the battery would never charge fully because the presence of the lock load reduces the charging voltage. Charging voltage must be controlled very accurately. A ten percent change can mean the difference between overcharging and not charging at all. Overcharging will rapidly dry out the battery's electrolyte resulting in a ruined battery.

2) Under weak battery conditions, the system will have insufficient energy to actuate the lock. This places a surge lock in the "hung" state described above, with power applied, but the bolt unretracted. Removing and reapplying the drive signal after the battery has recharged sufficiently to actuate the lock is the only way to clear this condition. Further, as noted above, it is generally necessary to remove the lock electrical load from the battery in order for the battery to recharge.

3) Some designs employed two batteries—one to provide the surge current and the other to provide the holding current. In these designs it is very difficult to get the batteries to charge at equal rates. The charging voltages were, necessarily, slightly different, causing one battery to slightly overcharge, while the other could never quite reach full charge.

BRIEF SUMMARY OF THE INVENTION

A power controller for electric locks which draw large startup current surges which controls and manages the energy of a pair of storage batteries to reliably operate such electric locks and provide steady-state power to auxiliary system components both with AC power present and in the absence thereof, so long as the stored charge in the batteries is able, to thereafter maintain a steady source of power to the system as long as possible, and to be self-starting upon the return of AC power, all without ever placing the electric locks in a partially unlocked or "hung" state. The two storage batteries are normally maintained charged through an AC power source, and both cooperate to provide the surge power. On loss of AC power, both still provide surge power so long as one can maintain the steady state power, and thereafter the other battery alone provides surge power so long as possible. On restart from a batteries discharged condition, surge power demand is tested periodically and immediately terminated when inadequate, thereby having minimal effect on the charging rate of the batteries.

BRIEF DESCRIPTION OF THE DRAWINGS

FIG. 1 comprising

DETAILED DESCRIPTION OF THE INVENTION

Figure 1A:
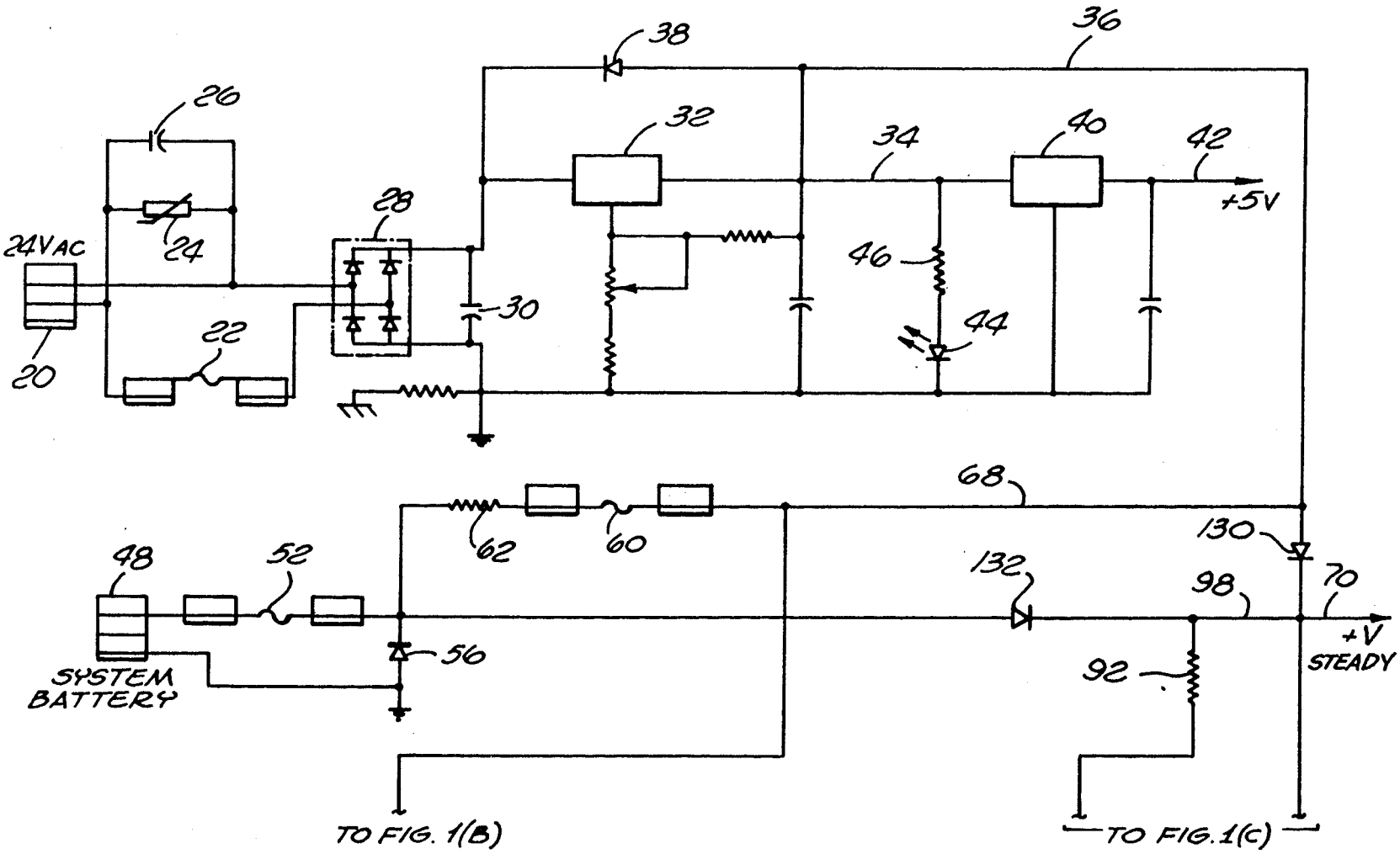
FIGS. 1A through 1C is a circuit diagram for the preferred embodiment of the present invention.
Figure 1B:
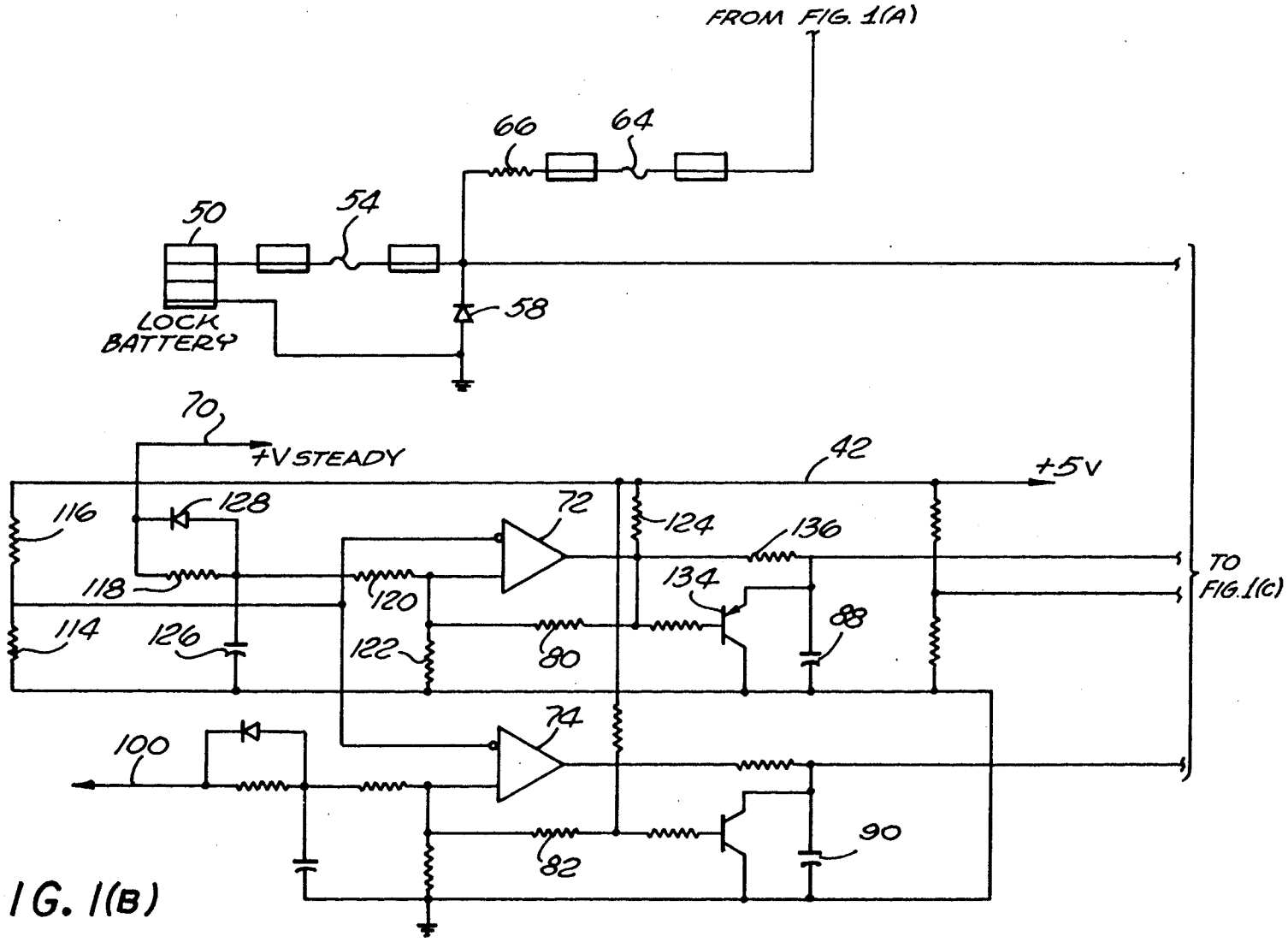
Figure 1C:
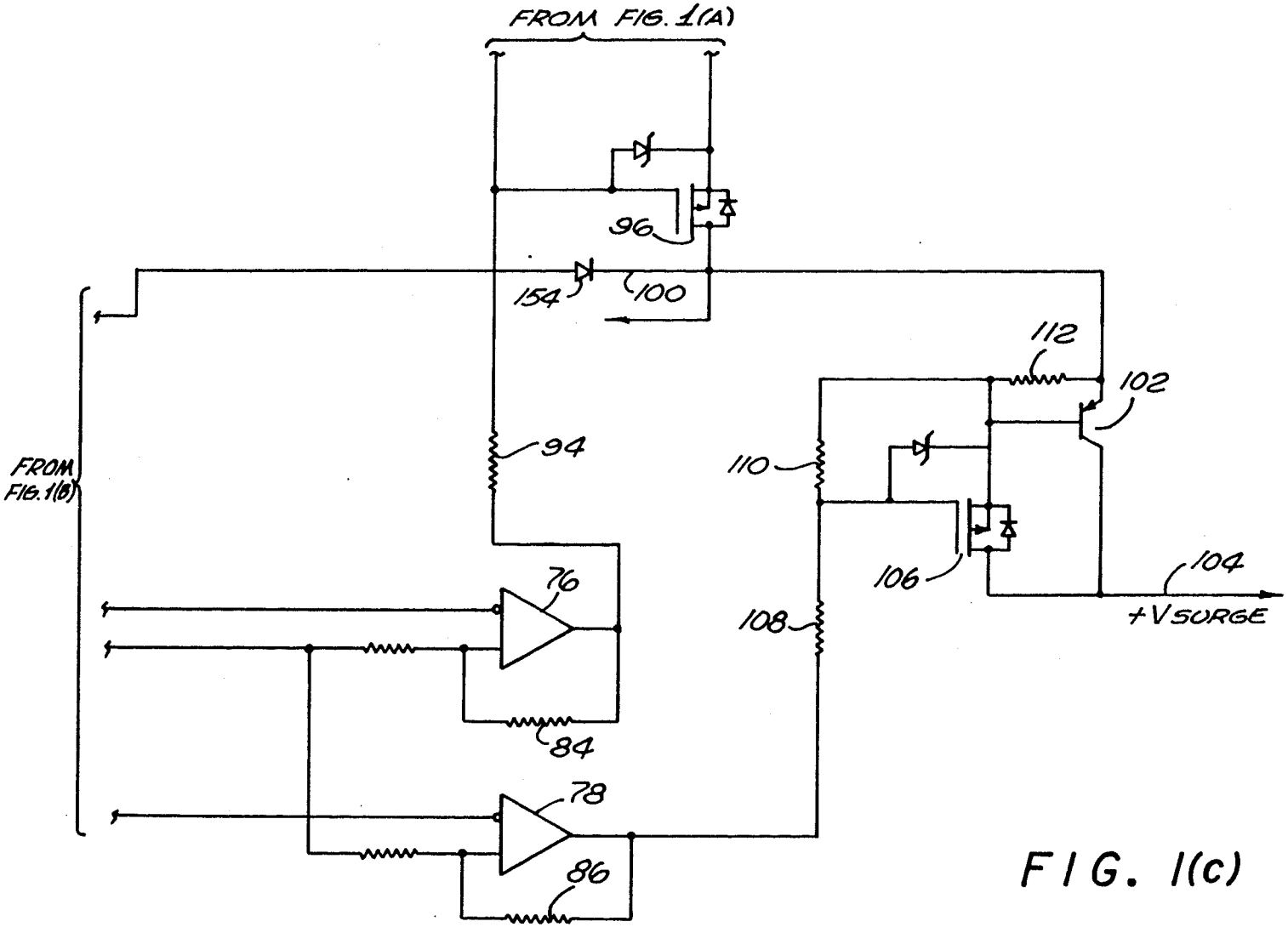

First referring to FIG. 1, a circuit diagram for a preferred embodiment of the present invention may be seen. In this embodiment, power for the system is provided typically from a conventional 115 volt 60 hertz power supply through a 24 VAC transformer coupled to the connector 20. The 24 VAC power is fused through fuse 22 and surge protected by limiter 24, with capacitor 26 providing high frequency filtering thereon. The 24 VAC is then full wave rectified by full wave rectifier 28 and at least partially filtered by capacitor 30. The resulting DC voltage is regulated by regulator 32, a three terminal adjustable regulator with fold back current limiting having a maximum current capacity of approximately 2.2 amps to provide 28.6 volts on lines 34 and 36, diode 38 providing protection to the regulator against any higher kickback voltages on line 36. The 28.6 volt DC voltage on line 34 is coupled to a fixed 5 volt regulator 40 providing a low power 5 volt output on line 42, LED 44 and current limiting resistor 46 providing a power-on indication for the power supply.

Also shown in FIG. 1 are batteries 48 and 50, each of which is a sealed lead acid storage battery of the type frequently referred to as gel-cells. These batteries are 28 volt batteries, battery 48 being referred to as a system battery and battery 50 being referred to as the lock battery, though in accordance with the invention the functions of the batteries are intertwined in a manner to be hereinafter described. Batteries 48 and 50 are each fused through fuses 52 and 54 respectively and protected from reverse voltages by diodes 56 and 58 respectively. For charging purposes each battery is connected to the 28.6 volt power on line 36 through an appropriate fuse and current limiting resistor, battery 48 through fuse 60 and resistor 62 and battery 50 through fuse 64 and resistor 66.

In normal operation the regulator 32 will provide adequate current output to maintain batteries 48 and 50 fully charged through line 68 and to provide 28 volt DC power to line 70 to power other parts of the electronic system not shown herein, such as, by way of example, electronic keypads for security code entry, card readers, code comparison systems, etc. as may be used in any particular system. In the exemplary embodiment described herein, the various devices powered by the 28 volt DC power on line 70 will operate satisfactorily at voltages as low as 18 volts which, as shall subsequently be seen, sets one of the parameters of the circuit yet to be described.

Forming a part of the circuit of FIG. 1 are sensing and timing circuits operative through comparators 72, 74, 76 and 78, in the preferred embodiment an LM339 quad comparator. The comparators 72, 74, 76 and 78 are each provided with positive feedback through resistors 80, 82, 84 and 86 respectively. The positive input for each of comparators 76 and 78 is provided through a resistor divider across the 5 volt supply voltage on line 42, with the negative input for comparators 76 and 78 being provided by the voltage across capacitors 88 and 90, respectively. Thus, the comparators 76 and 78 each will provide a low state output whenever the voltage on the capacitor coupled to the negative input thereof is higher than the reference voltage on the positive input thereof, and will provide a high state output when the voltage on the capacitor connected to the negative input thereof is below the reference voltage coupled to the positive input. In that regard, the positive feedback for each of comparators 76 and 78 is relatively slight, being intended primarily to provide positive state changes of the comparator output without causing much hysteresis in the comparator switching point.

LM339 comparators are characterized by an open collector NPN output transistor which is turned on in the low state output and is off in the high state output. Thus, resistors 92 and 94 act as pull up resistors for the open collector of the output transistor of comparator 76, with an intermediate voltage between the two resistors being used to control a discrete insulated gate bipolar transistor 96. This transistor, in essence, controls the connection between lines 98 and 100 and thus the connection between the outputs of the two batteries. Line 100 is coupled through a bipolar power transistor 102 to a surge current output line 104, with the state of transistor 102 being controlled by a second insulated gate bipolar transistor 106, in turn controlled by the output of comparator 78, resistors 108, 110 and 112 acting as pullup resistors therefor. When the gates of transistors 96 and 106 are high the same are turned on, the turning on of transistor 106 effectively shorting the base and collector of power transistor 102 to turn the same on. The high-current switches 96 and 106 need to be high-speed (tens of microseconds response times) and capable of carrying tens of amperes. IGBTs are currently the best solution because they are resistant to transient damage and, importantly, require very little drive current. Bipolar power technology alone requires too much drive current (which wastes a lot of power) and results in voltage drops which produce power dissipation levels high enough to require heat sinks on the transistors. The IGBTs need no heat sinks. Relays, of course, are far too slow. IGBTs will probably remain the best choice for a long time, but future FETs may have a low enough on resistance to serve by themselves.

The negative inputs to comparators 72 and 74 are coupled to a voltage divider comprising resistors 114 and 116 coupled to the 5 volt DC voltage on line 42 to provide a fixed reference to the negative inputs. The positive input for comparator 72 is coupled through line 70 through a voltage divider comprising resistors 118, 120 and 122, with resistor 124 providing the pullup resistor on the collector of the output transistor of comparator 72. In the case of this comparator, resistors 80, 122, 120, and 118 are selected relative to the reference voltage on the negative input to the comparator so as to provide a predetermined and substantial amount of hysteresis in the switching points for comparator 72 and of course to specifically define those switching points. In particular, in normal operation line 70 will be at 28 volts. The positive input to comparator 72 will be high relative to the negative input so that the output of the comparator will be pulled high by the pullup resistor 124. The various resistors hereinbefore mentioned are selected so that once the output of comparator 72 is high, the same will not switch to the low state until the voltage at line 70 drops to 18 volts, and once the same goes low, it will not again switch to the high state until the voltage on line 70 returns to at least 24 volts. The 18 volts of course represents the lower end of the voltage range for which the other electronic devices powered from the voltage on line 70 will be assured to operate properly, the 24 volts, as shall subsequently be seen, representing a voltage suggesting that battery 48 may have a significant charge thereon. In this circuit, capacitor 126 is provided primarily to avoid noise in the system by providing some small time lag in the rise of the positive input to comparator 72 in comparison to the rise in voltage on line 70, with diode 128 avoiding a similar time lag whenever the voltage on line 70 rapidly drops to below the 18 volt switching point from a voltage above 24 volts.

Line 70 is coupled to receive power from line 36 through diode 130 and from the system battery 48 to diode 132. Since the voltage regulator 32 providing power on line 36 must maintain the batteries charged, as well as provide the steady state power requirements on line 70 (and power voltage regulator 40), the power output of regulator 32 must at least somewhat exceed the steady state power requirements of the system. Also since battery 48 is charged through line 68 and resistor 62, and there is one diode voltage drop from line 36 to line 70 as well as one diode voltage drop between the voltage of battery 48 and line 70, the steady state power on line 70 will be provided by voltage regulator 32 through line 36, with battery 48 when fully charged being ready to contribute or supply power to line 70 if the voltage on line 36 drops such as, by way of example, upon loss of the 24 VAC power at connector 20. This, however, is not the only potential source of voltage drop on line 36 as shall be subsequently described.

When line 70 is held at 28 volts, the positive input to comparator 72 will be higher than the negative input, turning off transistor 134 and allowing resistor 136 to charge capacitor 88 to a voltage higher than the positive input of inverter 76. This in turn pulls the output of comparator 76 low, turning on transistor 96 so that power may be supplied to line 100 not only from the lock battery 50 but also from the system battery 48 as well as from the output of the voltage regulator 32 on line 36, as may be required. If, on the other hand, the voltage on line 70 is pulled below 18 volts for the specific embodiment being described, the output of comparator 72 will be toggled to the low state, turning on the output transistor for the comparator to pull the base of transistor 134 low, thereby shorting capacitor 88 to ground and quickly pulling the negative input of comparator 76 below the positive input thereto to turn off the output transistor of comparator 76, thereby allowing pullup resistor to pull the gate of transistor 96 up to the source voltage thereof to turn off the same. Thus, whenever the voltage on line 70 is less than 18 volts for any reason, the voltage on line 36 as well as the system battery 48 are both decoupled from line 100 so that any power demands thereon must be supplied solely by battery 50. Even when the voltage on line 70 later rises above 18 volts, the hysteresis of comparator 72 will hold the prior state thereof in the embodiment being described until the voltage again rises to 24 volts, at which time the state of comparator 72 toggles to turn the output transistor thereof off. Pullup resistor 124 then pulls the output of comparator 72 high, charging capacitor 88 through resistor 136 with a time constant selected to toggle comparator 76 low after approximately 6 seconds again turning on transistor 96. Thus, it may be seen that when the voltage on line 70 drops below 18 volts from a voltage above 24 volts, transistor 96 will be immediately turned off, and even if the voltage on line 70 substantially immediately thereafter jumps to above 24 volts, as it may do because of the turning off of transistor 96 to shed the majority of the load thereon, transistor 96 will not be again turned on until approximately 6 seconds thereafter, with the cycle repeating until such time as the voltage on line 70 no longer drops below 18 volts on the turnon of transistor 96, or no longer jumps to above 24 volts when transistor 96 turns off.

Comparator 74 and the circuitry associated therewith is identical to that of comparator 72 except as to the specific values of some of the circuit components, and also except for the fact that the positive input for inverter 74 is connected to line 100 rather than line 70. In particular, the components determining the switching points and hysteresis of comparator 74 in the embodiment being described, have been chosen to set the lower switching point at 12 volts and the upper switching point at 23 volts. Also, resistor 138 and capacitor 90 are selected to provide a 30 second delay when transistor 106 is turned off by the voltage on line 100 dropping below 12 volts, transistor 106 in turn controlling transistor 102, the same being on when transistor 106 is on and transistor 102 being off when transistor 106 is off.

Figure 2:
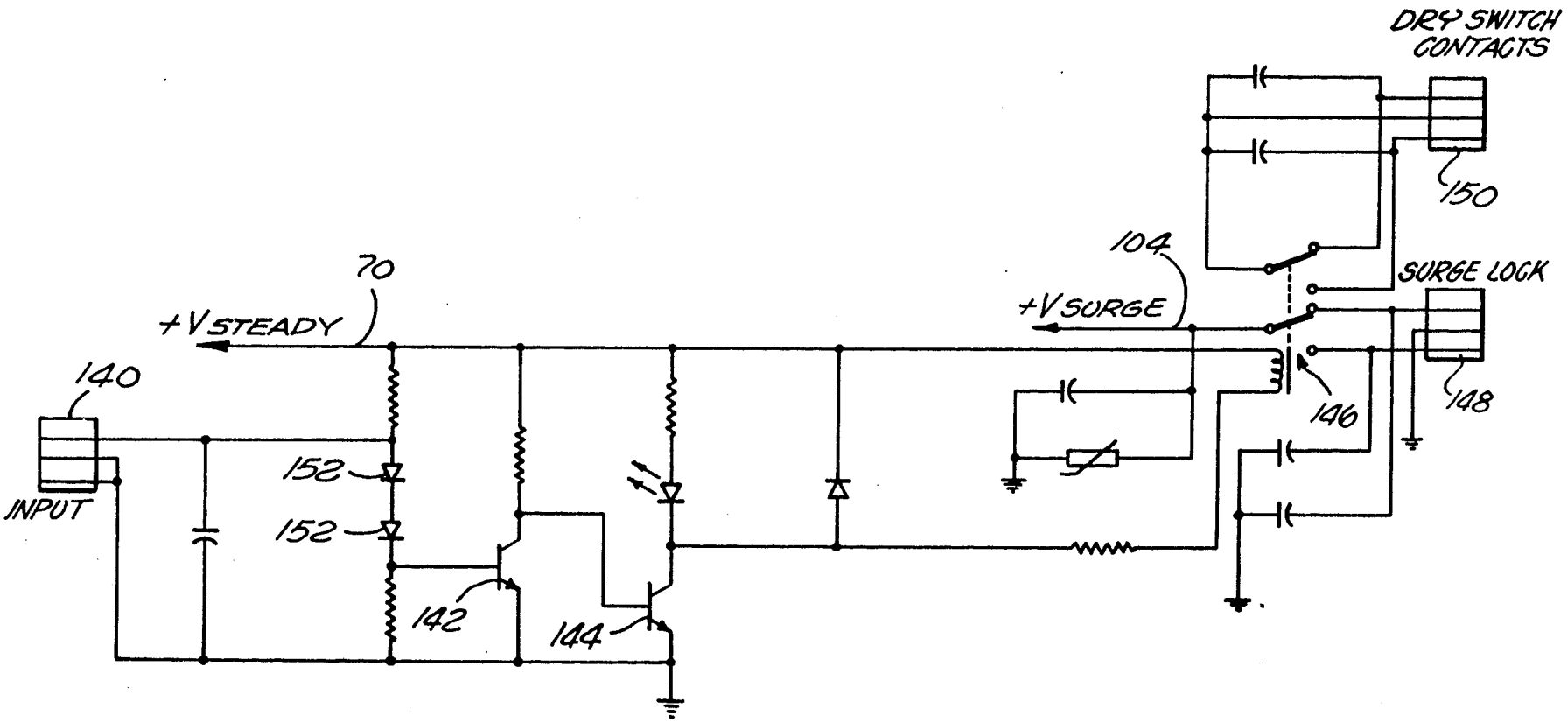
FIG. 2 is a circuit diagram for a typical surge lock relay control circuit.

Now referring to FIG. 2, a circuit diagram typical of the circuit used for powering each surge lock in the system may be seen. As shown therein, the circuit is coupled to line 70 supplying the steady state system power, and also to line 104 supplying the surge power for the locks. Coupled to connector 140 will be an appropriate device or subsystem (not shown) for providing a simple switch closure to operate the respective surge lock connected to connector 148. Normally without a switch closure input at connector 140, transistor 142 is held on and transistor 144 is held off, maintaining relay 146 in the state shown and providing the normally closed and normally open switch contact signals at connector 148. Similar switch states are also available as dry switch closures for use with external power sources at connector 150. When a switch closure signal is provided at connector 140 to operate the lock, the base of transistor 142 is pulled low turning the same off, thereby turning on transistor 144 to power the relay 146, opening the normally closed contacts thereof and closing the normally open contacts thereof to couple the surge power on line 104 through connector 148 to power the surge lock. In the embodiments specifically described herein, the surge locks used provide their own timing of the surge current, the same drawing approximately 16 amps for approximately 300 milliseconds and then dropping to approximately 0.5 amps of holding current. In the circuit shown in FIG. 2, diodes 152 are provided to provide positive circuit operation on a transistor switch closure, as well as a mechanical switch closure.

The overall operation of the circuit may be described as follows: When no surge locks are being operated, regulator 32 will provide sufficient 28 volt power on line 36 to power the steady state loads on line 70 and to charge and maintain charged the system battery 48 and the lock battery 50. The voltage on lines 70 and 100 will be 28 volts so that transistors 96, 106 and 102 will all be turned on. Thus, surge power voltage will be provided on line 104 awaiting the operation of one or more of the surge locks. Upon initiation of a surge lock the heavy load is applied thereby to line 104 (normally demanding approximately 16 amps). This load substantially exceeds the power output capability of regulator 32 so that the voltage on line 36 is pulled down somewhat, with the net result that the majority of the surge current demanded on line 104 is provided by system battery 48 and lock battery 50 acting in parallel. After the 300 millisecond high current power demand on line 104, the surge lock current will drop to approximately 0.5 amps for the duration of the operation of the lock, which current normally will be within the capacity of regulator 32 so that the output of regulator 32 will provide such holding current and recharge batteries 48 and 50 to the extent that they had been very slightly discharged by the operation of the lock.

Upon loss of the 24 VAC power, the power output of regulator 32 is lost. However, batteries 48 and 50 both supply power back through the charging circuits to hold line 34 substantially at the battery voltage to maintain power on regulator 40, diode 38 also holding the input of regulator 32 high to prevent damage thereto by the driving of the output of the regulator substantially higher than the input thereto. Also, battery 48 also supplies power for the steady state loads on line 70 through diode 132 and line 98, with the lock battery 50 assisting through diode 154 and switch 96. Because the voltages on lines 70 and 100 are both held relatively high, switches 96, 106 and 102 are held on. Accordingly, now when a surge lock is initiated, both batteries will apply power through switch 102 to start the surge lock so long as the voltage on line 70 does not drop below 18 volts. This will not happen so long as the batteries have a relatively good state of charge, though as the same are significantly discharged, the voltage on line 70 will drop further and further on each initiation (current surge) of a surge lock. When the batteries discharge to the extent that the voltage on line 70 does drop below 18 volts on the initiation of a surge lock, comparator 72 is toggled, thereby immediately turning off switch 96, decoupling battery 48 from the surge lock to allow the voltage on line 70 to remain above 18 volts and recover. If it does recover to above 24 volts the comparator 72 will again toggle, turning switch 96 on again after approximately 6 seconds. This of course will not cause the battery 48 to assist in delivering the surge current for the same operating cycle of a surge lock, though the same might assist in maintaining a holding current for the duration of the operation of the lock. Thus, it may be seen that the system battery assists in delivering the surge current so long as it can do so without dropping in voltage to the extent of endangering the operation of the circuits and devices comprising the steady state load on the system (the steady state load itself perhaps varying with time, though in general being relatively low in comparison to the surge current).

If the system battery 48 discharges to the extent that it will not recover to above 24 volts after switch 96 is turned off, the hysteresis in comparator 72 will maintain switch 96 off, leaving the delivery of the surge current demanded by the surge locks to the lock battery 50, the system battery 48 being preserved for operation of the steady state loads on line 70 (and of course on line 42) for so long as it thereafter can before discharging too far to maintain even such loads in proper operation. The lock battery 50 of course will itself power the surge locks so long as it can, though when the voltage on line 100 drops to below 12 volts upon initiation of a surge lock, comparator 74 will toggle to turn off switches 106 and 102 so that the surge locks cannot hang and/or the load presented thereby further significantly discharge the battery.

Ultimately of course, if the 24 VAC power is not reestablished within a reasonable length of time, both batteries will discharge to the extent of neither operating the surge locks nor the system in general and ultimately would completely discharge.

Assuming now that the batteries are substantially discharged before AC power is reestablished, both batteries will charge at a maximum possible rate upon reestablishment of the power. Because the batteries are charging through resistors 62 and 66 and the fact that the terminal voltage of the batteries will relatively quickly rise, five volt power will be available on line 42 substantially immediately, and steady state power will be available within approximately six seconds. The surge lock power is energized as soon as the batteries have accumulated enough charge to attempt to provide the necessary surge current for the particular load applied, namely for the embodiment disclosed, when the voltage on line 100 has reached 23 volts for a sufficient length of time to trigger comparator 78 to turn on switches 106 and 102. If the system is unable to start the surge lock, the condition is detected immediately (within a few tens of milliseconds) by the dropping of the voltage of line 100, thereby turning off switches 106 and 102 through comparator 74 and 78. Another attempt is made every 30 seconds after the battery voltage again rises to 23 volts, repeating at 30 second intervals until the lock starts successfully.

This technique of attempting periodically to actuate the surge locks solves several problems. The requirement that the surge locks receive a sudden application of power is guaranteed or the attempt to actuate the locks is aborted. These attempts at operating the surge lock, however, have little effect on the battery charging rate, as each unsuccessful attempt at operating a surge lock is so quickly aborted that no substantial battery energy is used therein. Thus the batteries will charge at 90% or more of the theoretical maximum rate, even though such attempts are repeated every 30 seconds until the same are successful. Obviously the frequency with which such attempts are repeated can be varied or even shortened without substantially decreasing the battery charging rate, though approximately 30 second intervals are preferred as any slight clicking noise of the locks made during each attempt is not loud enough nor frequent enough to be annoying, yet the 30 second delay does not substantially increase the length of time before the system is made operative, and any clicking sounds which the lock makes are not sufficiently frequent so as to be annoying.

There has been disclosed and described herein a new and unique surge lock power controller which has numerous advantages over prior art controllers, including the ability to apportion and manage battery power to efficiently operate surge locks with, or in the absence of an AC power source for so long as the batteries are capable of doing so, to thereafter maintain the system in readiness for as long possible, and finally, to be self starting from a battery discharged condition, all without the possibility of hanging up one or more surge locks or the entire system. While the invention functions as desired with surge locks in spite of their peculiar requirements and characteristics, it also can be used with ordinary magnetic (nonsurge) locks, making the power supply a universal supply in this respect. Also while the preferred embodiment of the invention has been disclosed and described herein in detail, it will be obvious to those skilled in the art that various changes in form and detail may be made therein without departing from the spirit and scope thereof. By way of a specific example, an equivalent design could be realized utilizing microprocessor control, though this is not preferred because of the complexity of the program that would be needed and the likely undesirable static electricity sensitivity of such a design. The preferred analog design, on the other hand, is extremely reliable, and cannot itself be hung in an abnormal state or endless loop.

We claim:

1. A surge lock power controller for providing electrical power to a lock system requiring steady state power and utilizing surge locks further requiring a short term high power surge to operate the same, comprising:

first and second rechargeable storage batteries;

recharging means coupled to the rechargeable storage batteries and for coupling to a power supply for charging the rechargeable storage batteries, the recharging means having a charging rate greater than the steady state power drain of a lock system and less than the power drain on the rechargeable storage batteries during the high power surge operation of one or more of the surge locks;

the first storage battery being coupled to a steady state power output to provide steady state power for a lock system;

first switch means coupled between the first storage battery and the second storage battery;

second switch means coupled between the second storage battery and a surge lock output to provide the power for the surge locks in a lock system;

first voltage sensitive means coupled to the first switch means responsive to the voltage of the steady state power output to turn off the first switch means for at least a first predetermined time whenever the voltage of the steady state power output drops below a first predetermined value; and, second voltage sensitive means coupled to the second switch means and responsive to the voltage of the second rechargeable storage battery to turn off the second switch means for at least a second predetermined time whenever the voltage of the second rechargeable storage battery drops below a second predetermined value;

the second predetermined value being less than the first predetermined value.

2. The surge lock power controller of claim 1 wherein the second predetermined time is substantially longer than the first predetermined time.

3. The surge lock power controller of claim 2 wherein the first predetermined time is longer than the period of the high power surge of a surge lock.

4. The surge lock power controller of claim 2 wherein the first and second voltage sensitive means each have a substantial hysteresis, the first voltage sensitive means, when the first switch means is off, turning the first switch means back on at a third predetermined voltage substantially higher than the first predetermined voltage, and the second voltage sensitive means, when the second switch means is off, turning the second switch means back on at a fourth predetermined voltage substantially higher than the second predetermined voltage.

5. The surge lock power controller of claim 4 wherein the third predetermined voltage is higher than the fourth predetermined voltage.

6. A method of providing electrical power to a lock system requiring steady state power and utilizing surge locks further requiring a short term high power surge to operate the same, comprising the steps of:

(a) providing first and second rechargeable storage batteries;

(b) providing recharging means coupled to the rechargeable storage batteries and to a power supply for charging the rechargeable storage batteries, the recharging means having a charging rate greater than the steady state power drain of a lock system and less than the power drain on the rechargeable storage batteries during the high power surge operation of one or more of the surge locks;

(c) coupling the first storage battery to a steady state power output to provide steady state power for the lock system;

(d) coupling the first storage battery and the second storage battery through a first switch;

(e) coupling the second storage battery and a surge lock output to provide the power for the surge locks in a lock system when both batteries are charged;

(f) sensing the voltage of the steady state power output and turning off the first switch means for at least a first predetermined time whenever the voltage of the steady state power output drops below a first predetermined value; and, (g) sensing the voltage of the second rechargeable storage battery and turning off the second switch means for at least a second predetermined time whenever the voltage of the second rechargeable storage battery drops below a second predetermined value, the second predetermined value being less than the first predetermined value.

7. The method of claim 6 wherein the second predetermined time is substantially longer than the first predetermined time.

8. The method of claim 7 wherein the first predetermined time is longer than the period of the high power surge of a surge lock.

9. The method of claim 7 wherein the sensing of the voltage of the steady state power output and the sensing of the voltage of the second rechargeable storage battery each have a substantial hysteresis, so that, when the first switch means is off, the first switch means turns back on at a third predetermined voltage substantially higher than the first predetermined voltage, and when the second switch means is off, the second switch means turns back on at a fourth predetermined voltage substantially higher than the second predetermined voltage.

10. The method of claim 9 wherein the third predetermined voltage is higher than the fourth predetermined voltage.

* * * * *